US008209801B2

(12) United States Patent
Shih

(10) Patent No.: US 8,209,801 B2
(45) Date of Patent: Jul. 3, 2012

(54) LEG LIFT MECHANISM FOR ELECTRIC BED OR CHAIR

(75) Inventor: Lung-Tan Shih, Changhua County (TW)

(73) Assignee: Ruoey Lung Enterprise Corp., Lu-Kang Town, Changchua County (TW)

( * ) Notice: Subject to any disclaimer, the term of this patent is extended or adjusted under 35 U.S.C. 154(b) by 0 days.

(21) Appl. No.: 13/341,481

(22) Filed: Dec. 30, 2011

(65) Prior Publication Data

US 2012/0096645 A1 Apr. 26, 2012

Related U.S. Application Data

(63) Continuation-in-part of application No. 12/607,975, filed on Oct. 28, 2009.

(51) Int. Cl.
*A61G 7/80* (2006.01)

(52) U.S. Cl. ..... 5/614; 5/616

(58) Field of Classification Search ..... 5/613–618, 5/600, 610

See application file for complete search history.

(56) References Cited

U.S. PATENT DOCUMENTS 4,996,731 A * 3/1991 Kruyt ..... 5/618
5,105,486 A * 4/1992 Peterson ..... 5/611
RE35,201 E * 4/1996 Krauska ..... 5/618

* cited by examiner

*Primary Examiner* — Fredrick Conley
(74) *Attorney, Agent, or Firm* — Muncy, Geissler, Olds & Lowe, PLLC

(57) ABSTRACT

A leg lift mechanism for an electric bed or chair includes a primary frame, having a first structural component mounted with a bed frame and pivotally connected with a driver, a second structural component pivotally connected with the first structural component, a third structural component pivotally connected with the second structural component, a first angle bracket mounted with the second structural component, a lift bracket pivotally connected with the bed frame and abutted against the third structural component, and a second angle bracket mounted with the lift bracket. A link rod has an end pivotally connected with an extendable rod of the driver through a control pin inserted into a sliding slot of the first angle bracket, and the other end pivotally connected with the second angle bracket. Thus, the link rod can be driven by the driver to cause different movements of the primary frame.

7 Claims, 5 Drawing Sheets

LEG LIFT MECHANISM FOR ELECTRIC BED OR CHAIR

CROSS-REFERENCE TO RELATED APPLICATIONS

This application is a Continuation-in-Part of co-pending Application No. 12/607,975, filed on 28 Oct. 2009, and for which priority is claimed under 35 U.S.C. §120, the entire contents of which are hereby incorporated by reference.

BACKGROUND OF THE INVENTION

1. Field of the Invention

The present invention relates generally to an electric bed or chair, and more specifically to a leg lift mechanism for an electric bed or chair, which can perform multiple pivotal movements.

2. Description of the Related Art

Currently, most bed frames are designed for a user to lay flat while sleeping, and a typical bed frame includes four legs and supports. However, due to the stresses of modern life, many people suffer from insomnia and therefore suffer from a lack of sufficient rest. Consequently, many bed frames have included additional features, such as providing electrical head or leg lifting capabilities, and the user can select and adjust proper positions for him or herself. In the prior art, an electromechanical bed frame includes an upper portion frame, a fixed portion frame, and a lower portion frame. When the user wants to lift his or her head higher, the upper portion frame pivots around a connection region between the upper portion frame and the fixed portion frame to lift the other end of the upper portion frame; if the user wants to lift his or her lower legs higher, the lower portion frame pivots around the connection area between the lower portion frame and the fixed portion frame to lift the other end of the lower portion frame. However, the prior art bed structure can only lift one area at a time, which may be uncomfortable for the user.

Therefore, it is desirable to provide a leg lift mechanism for an electrical bed or chair to mitigate and/or obviate the aforementioned problems.

SUMMARY OF THE INVENTION

The present invention has been accomplished in view of the above-noted circumstances. It is therefore one objective of the present invention to provide a leg lift mechanism for an electric bed or chair, which has multiple pivotal movements for enhancing a user's comfort.

To achieve this objective of the present invention, the leg lift mechanism comprises a bed frame, a primary frame, a driver, and a link rod. The primary frame includes a first structural component mounted with the bed frame, a second structural component pivotally connected with the first structural component through a first connecting element, a third structural component pivotally connected with the second structural component through a second connecting element, a first angle bracket mounted with the second structural component, a second angle bracket having an aperture, and a lift bracket having a pivot member pivotally connected with the bed frame and mounted with the second angle bracket, and a support portion abutted against the third structural component. The driver includes a positioning portion pivotally connected with the first structural component through a first pin inserted through a securing aperture of the first structural component, and an extendable rod having a through hole aligned with a sliding slot of the first angle bracket. The link rod is pivotally connected with the extendable rod of the driver by a control pin inserted into the sliding slot of the first angle bracket, the through hole of the extendable rod and a first aperture of the link rod, and pivotally connected with the second angle bracket by a second pin inserted into the aperture of the second angle bracket and a second aperture of the link rod.

By this way, when the link rod is pushed by the extendable rod of the driver, the lift bracket will be forced to pivotally move upwards by the link rod through the second angle bracket, and then the third structural component can be lifted by the lift bracket, and simultaneously the control pin is slidable in the sliding slot of the first angle bracket. Once the control pin is stopped against the rear semicircular end of the sliding slot, the second structural component will be lifted by the extendable rod through the first angle bracket, thereby causing different movements of the primary frame.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
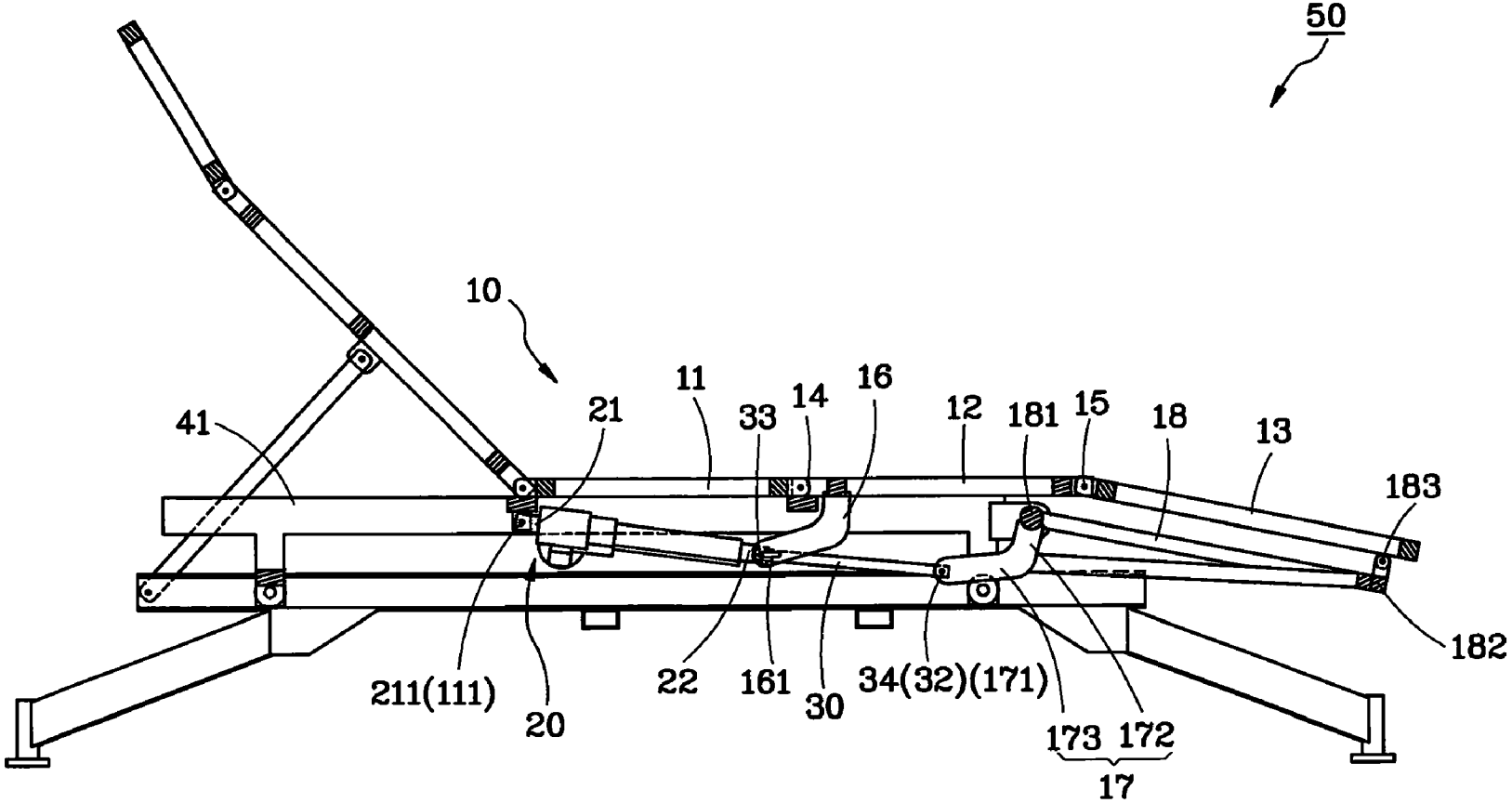
FIG. 1 is a schematic drawing of the leg lift mechanism according to an embodiment of the present invention.

As shown in FIG. 1, a leg lift mechanism 50 for an electric bed or chair in accordance with a preferred embodiment of the present invention comprises a bed frame 41, a primary frame 10, a driver 20, and a link rod 30.

Figure 2:
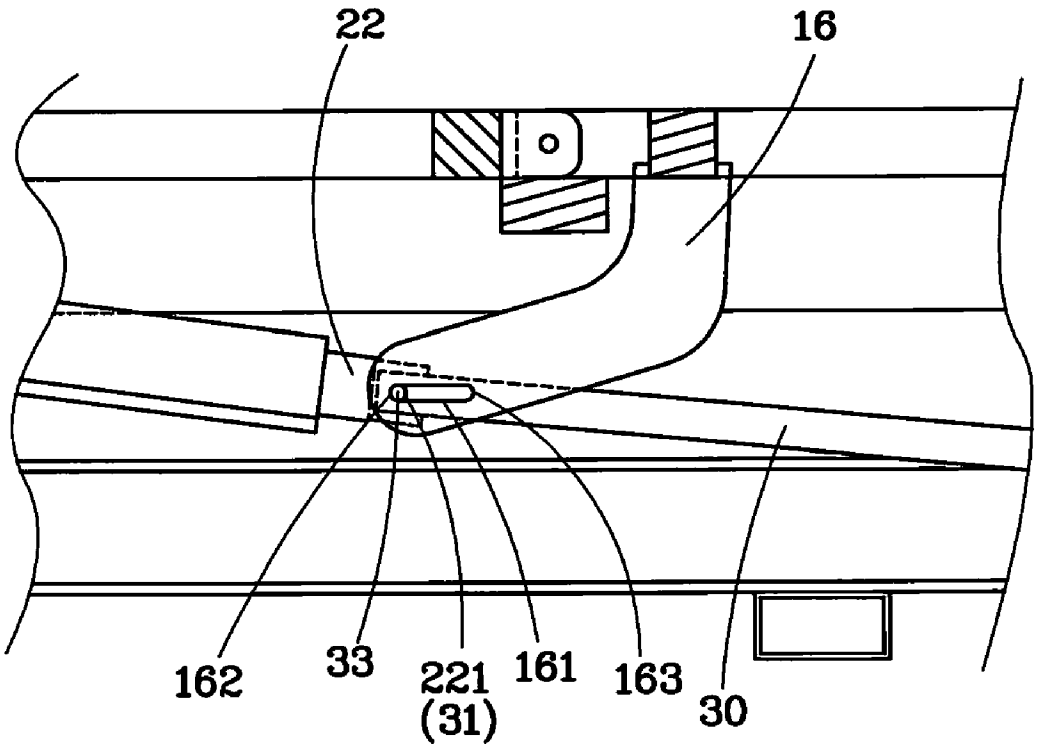
FIG. 2 is an enlarged view of a part of FIG. 1.

A mattress (not shown) can be placed on the primary frame 10 for allowing a user to lie down. The primary frame 10 includes a first structural component 11 mounted with the bed frame 41 and having a securing aperture 111, a second structural component 12 pivotally connected with the first structural component 11 through a first connecting element 14, and a third structural component 13 pivotally connected with the second structural component 12 through a second connecting element 15. Furthermore, two first angle brackets 16 are spacedly mounted with the second structural component 12. Each of the first angle brackets 16 is provided with a sliding slot 161, which is an elongated through hole with a front semicircular end 162 and a rear semicircular end 163, as shown in FIG. 2. Two second angle brackets 17 each have a straight portion 172 and a traverse portion 173 transversely extending from a bottom end of the straight portion 172 and having an aperture 171. A lift bracket 18 has a pivot member 181 pivotally connected with the bed frame 41 for connection of a top end of each of the straight portions 172 of the second angle brackets 17, and a support portion 182 abutted against a bottom of the third structural component 13 through two rollers 183. To deserve to be mentioned, the primary frame 10 can be provided with only one first angle bracket 16 and one second angle bracket 17. Further, the second angle bracket 17 can be designed into various shapes, and the rollers 183 can be eliminated according to actual needs.

The driver 20 can be an electric motor, pneumatic device or hydraulic device, including a positioning portion 21 at one end thereof and an extendable rod 22 at the other end thereof. The driver 20 is pivotally connected with the first structural component 11 by means of a first pin 211 inserted into the positioning portion 21 of the driver 20 and the securing aperture 211 of the first structural component 11. The end of the extendable rod 22 is located between the first angle brackets 16 and has a through hole 221 aligned with the sliding slots 161 of the first angle brackets 16, as shown in FIG. 2.

The link rod 30 is pivotally connected with the driver 20 in such a way that a control pin 33 is inserted into a first aperture 31 of one end of the link rod 30 and the through hole 221 of the driver 20 through the sliding slots 161 of the first angle brackets 16. The link rod 30 has the other end located between the second angle brackets 17 and provided with a second aperture 32. A second pin 34 is inserted into the second aperture 32 of the link rod 30 and the apertures 171 of the second angle brackets 17, such that the link rod 30 and the second angle brackets 17 are pivotally connected with each other.

Figure 3:
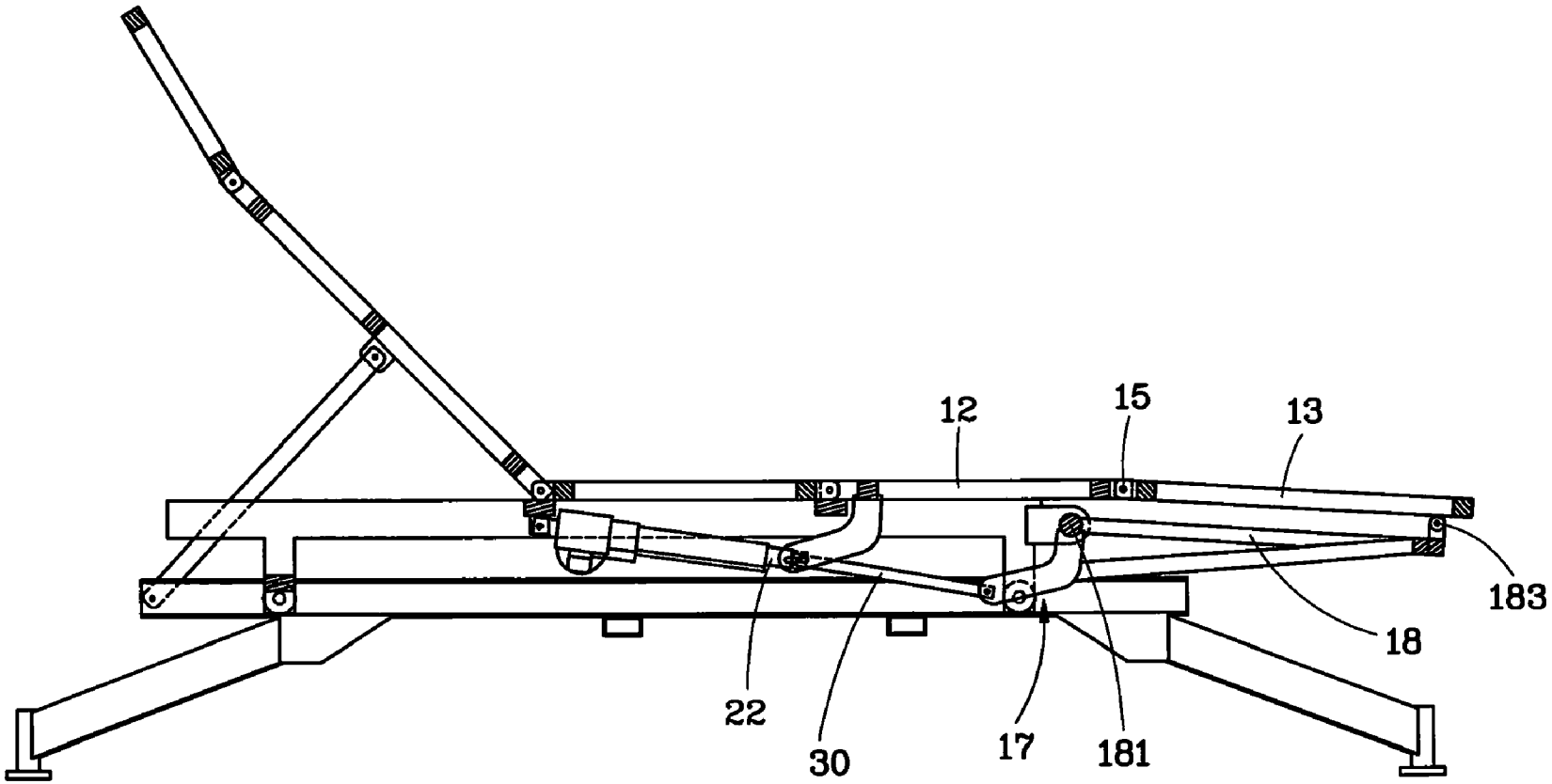
FIG. 3 is similar to FIG. 1, but showing the third structural component of the primary frame is moved upwards.
Figure 4:
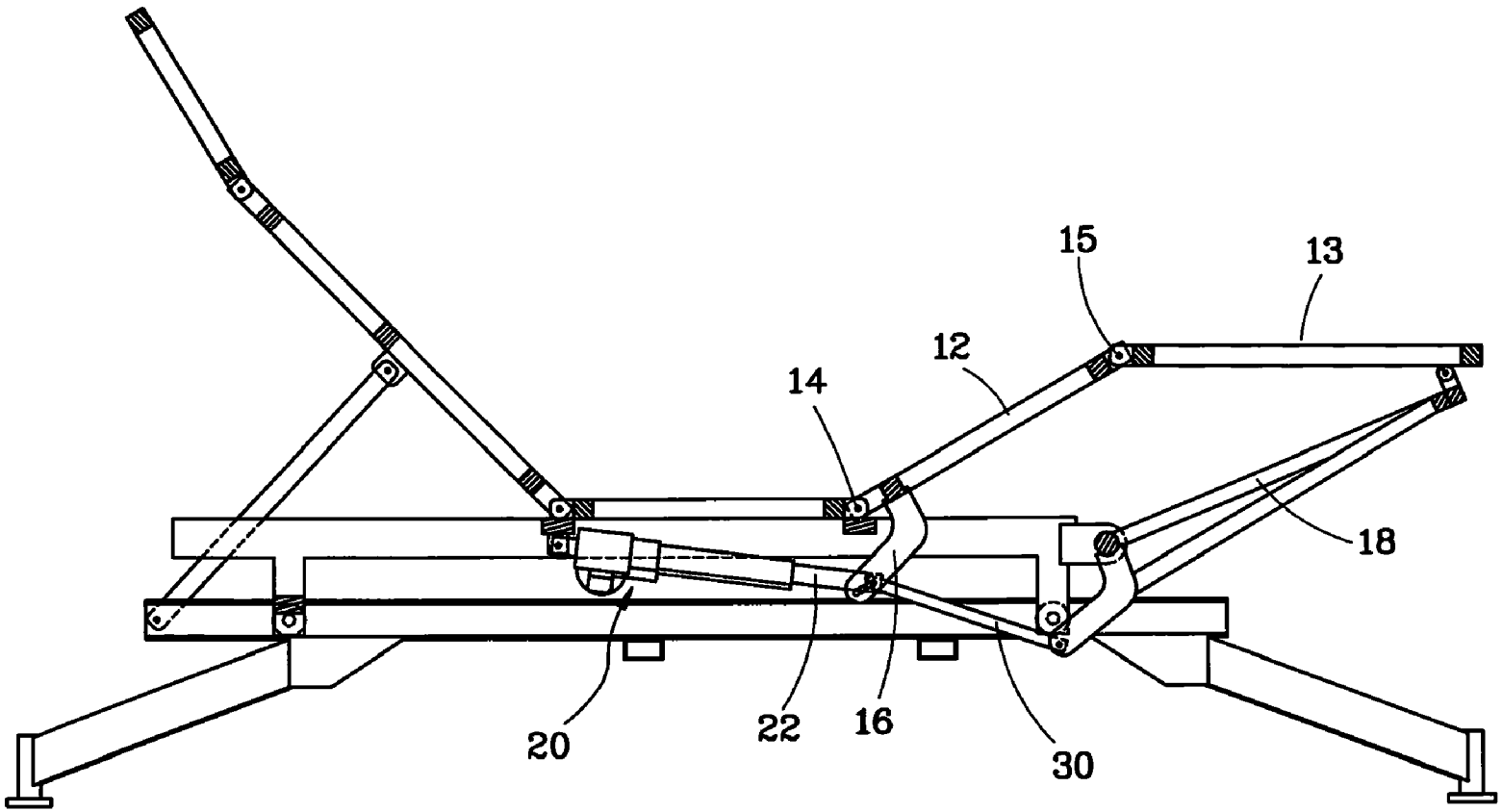
FIG. 4 is similar to FIG. 3, but showing the second structural component of the primary frame is moved upwards.
Figure 5:
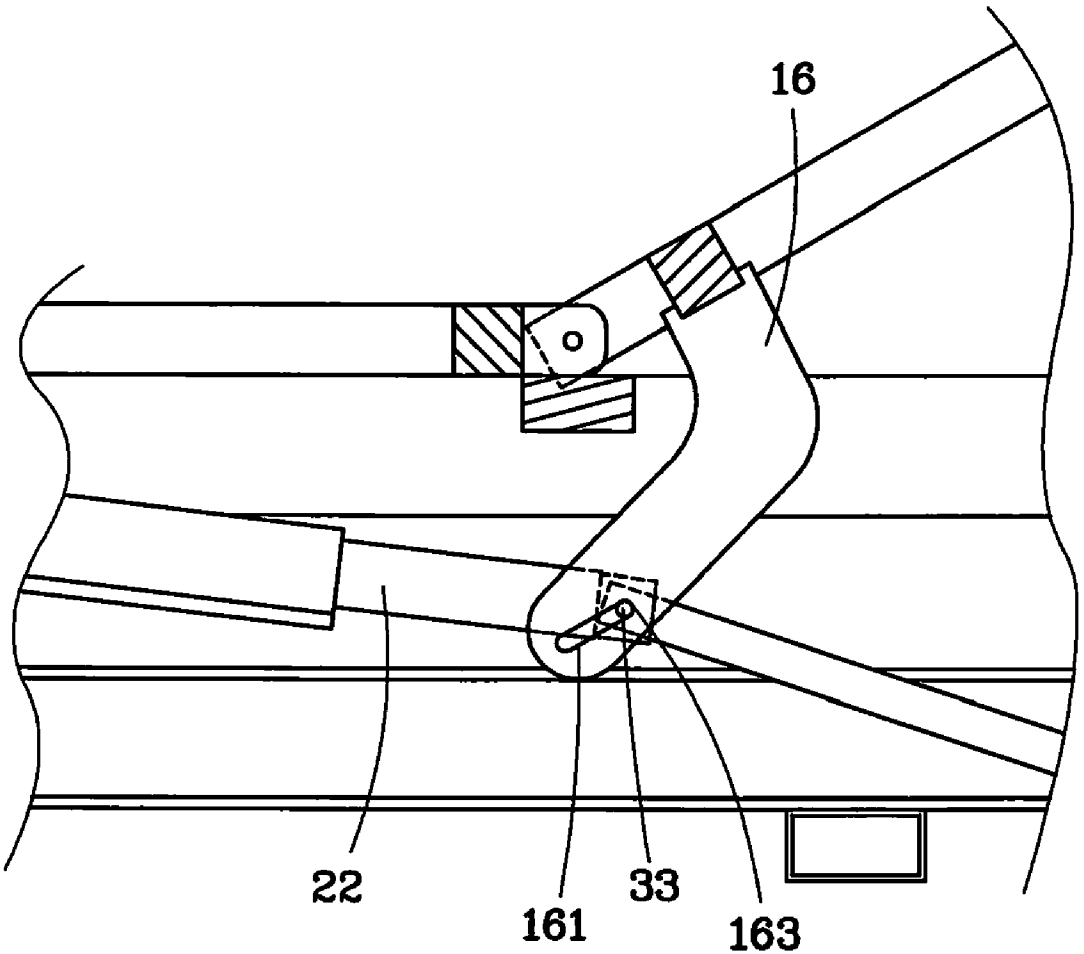
FIG. 5 is an enlarged view of a part of FIG. 4.

When the extendable rod 22 of the driver 20 extends, the control pin 33 is pushed by the extendable rod 22 to move from the front semicircular end 162 toward the rear semicircular end 163 of the sliding slot 16. During the movement of the control pin 33, the link rod 30 is driven by the control pin 33 to push the second angle brackets 17, such that the second angle brackets 17 are turned about the pivot member 181 to lift the lift bracket 18. Sequentially, the third structural component 13 will be pushed by the lift bracket 18 through the rollers 183 to turn about the second connecting element 15, as shown in FIG. 3. At this stage, the second structural component 12 is stationary and substantially flush with the third structural component 13. Once the control pin 33 reaches and urges against the rear semicircular end 163 of the sliding slot 16, as shown in FIG. 5, the control pin 33, which is connected with the extendable rod 22 that is continuously extending, will push the first angle brackets 16 through an acting force applied from the extendable rod 22 of the driver 20, causing the second structural component 12 to counterclockwise turn about the first connecting element 14. At this stage, the lift bracket 18 is forced by the link rod 30 to keep pushing the third structural component 13 upwards, such that the third structural component 13 is lifted with a little downward inclination, as shown in FIG. 4.

By means of the aforesaid design, when the user lies on the mattress stacked on the primary frame 10 and the extendable rod 22 extends, the user's lower legs will be lifted first through the pivotal movement of the third structural component 13, and then the user's thighs will be lifted later through the pivotal movement of the second structural component 12. Thus, the user can adjust the body into a comfortable posture to use the leg lift mechanism 50 of the present invention through the two-step pivotal movement.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A leg lift mechanism for an electric bed or chair, comprising:

a bed frame;

a primary frame including a first structural component mounted with the bed frame and having a securing aperture, a second structural component pivotally connected with the first structural component through a first connecting element, a third structural component pivotally connected with the second structural component through a second connecting element, at least one first angle bracket mounted with the second structural component and having a sliding slot, at least one second angle bracket having an aperture, and a lift bracket having a pivot member pivotally connected with the bed frame and mounted with the second angle bracket, and a support portion abutted against a bottom of the third structural component;

a driver including a positioning portion at one end pivotally connected with the first structural component through a first pin inserted through the securing aperture of the first structural component, and an extendable rod at the other end having a through hole aligned with the sliding slot of the first angle bracket; and a link rod including a first aperture at an end and a second aperture at the other end, the end of the link rod being pivotally connected with the extendable rod of the driver by a control pin inserted into the sliding slot of the first angle bracket, the through hole of the extendable rod and the first aperture of the link rod, and the other end of the link rod being pivotally connected with the second angle bracket by a second pin inserted into the aperture of the second angle bracket and the second aperture of the link rod, such that the link rod can be driven by the driver to cause different movements of the primary frame.

2. The leg lift mechanism as claimed in claim 1, wherein the second angle bracket comprises a straight portion having a top end mounted with the pivot member of the lifting bracket, and a transverse portion transversely extending from a bottom end of the straight portion and having the aperture.

3. The leg lift mechanism as claimed in claim 1, wherein the support portion of the lifting device is abutted against the third structural component through at least one roller.

4. The leg lift mechanism as claimed in claim 1, wherein the primary frame comprises two said first angle brackets between which an end of the extendable rod of the driver is located.

5. The leg lift mechanism as claimed in claim 1, wherein the primary frame comprises two said second angle brackets between which the other end of the link rod is pivotally connected.

6. The leg lift mechanism as claimed in claim 1, wherein the sliding slot of the first angle bracket is an elongate through hole with a front semicircular end and a rear semicircular end.

7. The leg lift mechanism as claimed in claim 1, wherein the driver is selected from the group consisting of an electric motor, pneumatic device, and hydraulic device.

* * * * *